US007686698B2

(12) United States Patent
Namala et al.

(10) Patent No.: US 7,686,698 B2
(45) Date of Patent: Mar. 30, 2010

(54) STORAGE BIN FOR PIN-SPOTTER APPARATUS FOR BOWLING, AND METHOD OF MANUFACTURE THEREOF

(75) Inventors: Samuel R. Namala, Mechanicsville, VA (US); LeRoy T. Warren, Jr., Richmond, VA (US); Charles A. Lee, Williamsburg, VA (US); Paul Becker, Richmond, VA (US)

(73) Assignee: QUBICAAMF Worldwide LLC, Mechanicsville, VA (US)

( * ) Notice: Subject to any disclaimer, the term of this patent is extended or adjusted under 35 U.S.C. 154(b) by 162 days.

(21) Appl. No.: 11/766,604

(22) Filed: Jun. 21, 2007

(65) Prior Publication Data

US 2008/0004125 A1 Jan. 3, 2008

Related U.S. Application Data

(60) Provisional application No. 60/817,417, filed on Jun. 30, 2006.

(51) Int. Cl.
*A63D 5/09* (2006.01)

(52) U.S. Cl. ..... 473/64; 473/89; 473/95

(58) Field of Classification Search ..... 473/64, 473/83, 84, 86–90, 92, 94–96
See application file for complete search history.

(56) References Cited

U.S. PATENT DOCUMENTS

| | | | |
|---|---|---|---|
| 2,969,983 | A | 1/1961 | De Vore |
| 3,248,109 | A | 4/1966 | Blewitt, Jr. et al. |
| 3,526,410 | A | 9/1970 | Grover |
| 4,169,602 | A | 10/1979 | Heddon |
| 5,439,418 | A | 8/1995 | Stephens |

OTHER PUBLICATIONS

Wikipedia.org website, Rotational molding and Thermoforming; http://en.wikipedia.org/wiki/Rotational_molding and http://en.wikipedia.org/wiki/Thermoforming, 2009.*

Thermoforming, by George Gruenwald, Published by CRD Press, p. 197, 1998.*

Mayfield Plastics website, http://www.mayfieldplastics.com/thermoforming-v-rotomolding.html, Thermoforming or Rotomolding?, 2008.*

* cited by examiner

*Primary Examiner*—William M Pierce
(74) *Attorney, Agent, or Firm*—Greenblum & Bernstein P.L.C.

(57) ABSTRACT

A bowling pin storage bin assembly for use as part of a bowling pin delivery system of a pinspotter apparatus, as well as a method of manufacturing such bin. The storage bin is molded as a one-piece article having a plurality of cavities or pockets for storing bowling pins in an essentially horizontal plane above a pin spotter and for delivering the pins to a plurality of pin cups or a pin spotter for spotting on a pin deck.

19 Claims, 7 Drawing Sheets

STORAGE BIN FOR PIN-SPOTTER APPARATUS FOR BOWLING, AND METHOD OF MANUFACTURE THEREOF

CROSS REFERENCE TO CO-PENDING APPLICATIONS

The present invention claims priority under 35 U.S.C. §119 to provisional application Ser. No. 60/817,417,filed on Jun. 30, 2006,the contents of which are expressly incorporated by reference herein.

BACKGROUND OF THE INVENTION

1. Field of the Invention

The invention relates to a bowling pin storage bin for use as part of a bowling pin delivery system of a pinspotter apparatus, as well as a method of manufacturing such bin. More particularly, in a particular embodiment, the storage bin of the invention is molded as a one-piece article having a plurality of cavities or pockets for storing bowling pins in an essentially horizontal plane above a pin spotter and for delivering the pins to a plurality of pin cups or a pin spotter for spotting on a pin deck.

2. Description of Background and Relevant Information

A pin spotting apparatus performs a number of conventional functions in the sport of bowling, and it includes the necessary mechanical and electrical components therefor. Included in these functions are stopping the bowler's ball, returning the ball to the bowler, setting the pins at the beginning of a frame, and resetting pins for a second ball of the frame if a strike is not scored.

During successive bowling frames, the pins which are knocked down and pins that remain standing after each frame are generally delivered directly to the spotting machine or to a storage device from which pins are supplied on demand. The mechanical components of a pin spotting apparatus include the cushion, which stops the ball and deflects it to the pit area to be returned to the bowler; the sweep, which removes fallen pins from the pin deck and adjacent gutters; the carpet, which is a belt that carries the fallen pins to the pin elevator, where they are can-led up to the distributor; the pin elevator, which carries the pins from the pit area and delivers them to the distributor; the distributor, which delivers the pins from the pin elevator to the bin assembly; the ball lift, which lifts the ball to a height that will enable gravity to return the ball to the bowler; the bin and shuttle assembly, the bin of which stores pins received from the distributor until the pins are ready for spotting, and the shuttle of which is movably mounted beneath the bin to allow stored pins to be dropped into the pin-spotting table; and the pin-spotting table, which performs the spotting and re-spotting functions by means of two assemblies, i.e., the yoke assembly, which supports ten spotting cups, and the table assembly, which houses ten re-spot cell assemblies. Once the pins are spotted, or re-spotted, the lane is ready for the game to continue or for a new game to begin.

It is desirable to provide pins to the pin spotting machines rapidly so that a game of bowling can be played swiftly without undue delays. It is important, therefore, that the pin distributing system keeps pace with the spotting machine and provides pins rapidly thereto and in a position for spotting on the pin deck. It is also important that any such mechanism minimize the likelihood of jams, misplaced pins or other failure which would take an alley out of service and/or cause and unacceptable delay in a game of bowling.

Prior bowling pin distribution systems include the system disclosed in U.S. Pat. No. 3,248,109.That system includes a mechanical pin distribution structure combined with an electrical operating system for programming the sequence of pin distribution. The distributor includes a conveyor having a cantilevered arm which swings transversely above a receiver to which pins are delivered. The principal mechanical parts other than the swinging distributor are simple elements which deflect pins to assigned locations in the receiver. The distributor is indexed to move successively to various positions by a central control system to appropriately distribute the pins to the receiver.

The receiver of the U.S. Pat. No. 3,248,109 system includes a storage section, or storage bin, that defines a plurality of ten pin-receiving pockets arranged in a pattern that conforms to the regulation array of pins spotted on a bowling alley. The storage section is supported from beneath by a frame, the frame and storage section being positioned below the distributor and above a spotting table. Each of the ten pin-receiving pockets is bottomless and the opening at the bottom of the pocket is obstructed by one of a plurality of bin cups. Each of the bin cups has an internal shape which is compatible with that of a bowling pin and, when positioned, is adapted to cradle a bowling pin. Subsequently, the cups rotate to drop their pins to be positioned on the spotting table.

U.S. Pat. No. 3,526,410 discloses a similar system. Pin storage bins of the pin distribution systems of both of these patents are made from sheet steel and various ancillary components.

FIG. 1 of the attached drawing illustrates an example of a known pin spotter bin 1, constructed largely of sheet steel from hundreds of parts, having ten pin cavities 2*a*-2*j*. Among these many parts are pin guides 3 within the cavities, bin assembly brackets 4 with bumpers 5, spacers 6, left and right pin guides 7, 8, pin butt guides 9, channels 10, 11 and stringers 12 between the channels, as well as a multitude of springs, nuts, bolts, sleeves, brackets, etc. The metal bin of FIG. 1 holds twenty pins (not shown), one in each cavity as well as a second layer of ten pins lying on top of the cavity-held layer of ten pins.

As an improvement over the aforementioned bowling pin distribution systems, which are largely manufactured from sheet steel and various ancillary components, U.S. Pat. No. 5,439,418 discloses a storage bin, or pin-spotter bin, molded from plastic. Intended advantages of this storage bin were to include a simplified design, enabling the system of which it is a component to require fewer parts, therefore contributing to durability of the system, facilitating and minimizing maintenance, thereby reducing alley down time. In addition, the disclosed bin was intended to be relatively easy to manufacture and install, both at a relatively low cost compared to the prior storage bins. Further, a plastic bin would reduce noise caused by pin impacts during use, and the surfaces of the pins would not be marred or scratched as they are during impacts with current metal bins. The specification of U.S. Pat. No. 5,439,418 explains that a rotational molding method of fabrication, sometimes referred to as "rotomolding," can be used to make a plastic bin according to the disclosure, using a linear low-density polyethylene (LDPE).

Despite the intended advantages of the storage bin of U.S. Pat. No. 5,439,418 and advances that would be made over the prior art and bins in current use, problems have been identified that prevent such molded bins from functioning optimally and that have prevented such a bin from becoming commercially acceptable.

Rotational molding, which relies upon gravity acting upon molten plastic inside a mold, is known to be used for the manufacture of large, hollow-shaped articles, such as boat hulls, fuel and storage tanks, shells for luggage, and various types of containers. A quantity of polymer powder is loaded into the interior of a two-part mold, which is then heated and rotated simultaneously about two perpendicular axes, thereby spreading the polymer particles onto all internal surfaces of the mold, the heated polymer becoming fused into a single melted layer. While continuing to be rotated, the mold is then cooled so that the plastic layer becomes solidified. The mold is then opened and the plastic article is removed.

Because the coating of the internal walls of the mold with the melted plastic is done by gravity rather than by centrifugal force, rotational speeds are relatively slow. However, rotomolding is typically preferred for making articles that have more complex geometries, for relatively larger articles, and ones that have lower production quantities than, say, blow molding or related molding processes that are used to make hollow parts from thermoplastics. Accordingly, the one-piece bin of U.S. Pat. No. 5,439,418,which is a hollow piece having a relatively complex geometry, is disclosed as being made by rotomolding. Mention is made that another method of fabrication could be used, although not described. U.S. Design Pat. No. 366,510 provides further views of the bin.

U.S. Pat. No. 5,439,418 cites low-density polyethylene (LDPE) as an example of a material from which the bin can be made by the disclosed process of rotomolding. However, due to the nature of the rotomolding process and the hollow structure that characterizes the article produced by that process, even high-density polyethylene (HDPE), regarded by persons skilled in the technology as the best material that could be used, i.e., providing somewhat greater stiffness at a somewhat greater cost, does not have the necessary impact resistance to create a bin that could function very long without cracking or succumbing to material fatigue.

In addition to potential problems associated with the materials and the construction of the bin of U.S. Pat. No. 5,439,418,the particular geometries of the ten pockets, or cavities, disclosed therein are not found to be optimum in efficiently receiving pins from the distributor for being temporarily stored and made ready for being fed to the spotting table.

SUMMARY OF THE INVENTION

The invention provides a plastic bowling pin storage bin for a pin spotting apparatus, which bin retains advantages over prior metal bins and which provides for an adequate impact resistance, does not suffer from premature material fatigue, but which can provide extended use cycles without damage or need for repair or maintenance caused by impacts with bowling pins.

Additionally, the invention provides such storage bin to have pockets which have geometries to provide that pins received from the distributor are efficiently received and quickly settled.

BRIEF DESCRIPTION OF THE DRAWINGS

The invention will be better understood from the following description, with reference to the attached drawings, which illustrate exemplary embodiments for carrying out the invention, and in which.

DETAILED DESCRIPTION OF THE INVENTION

Figure 2:
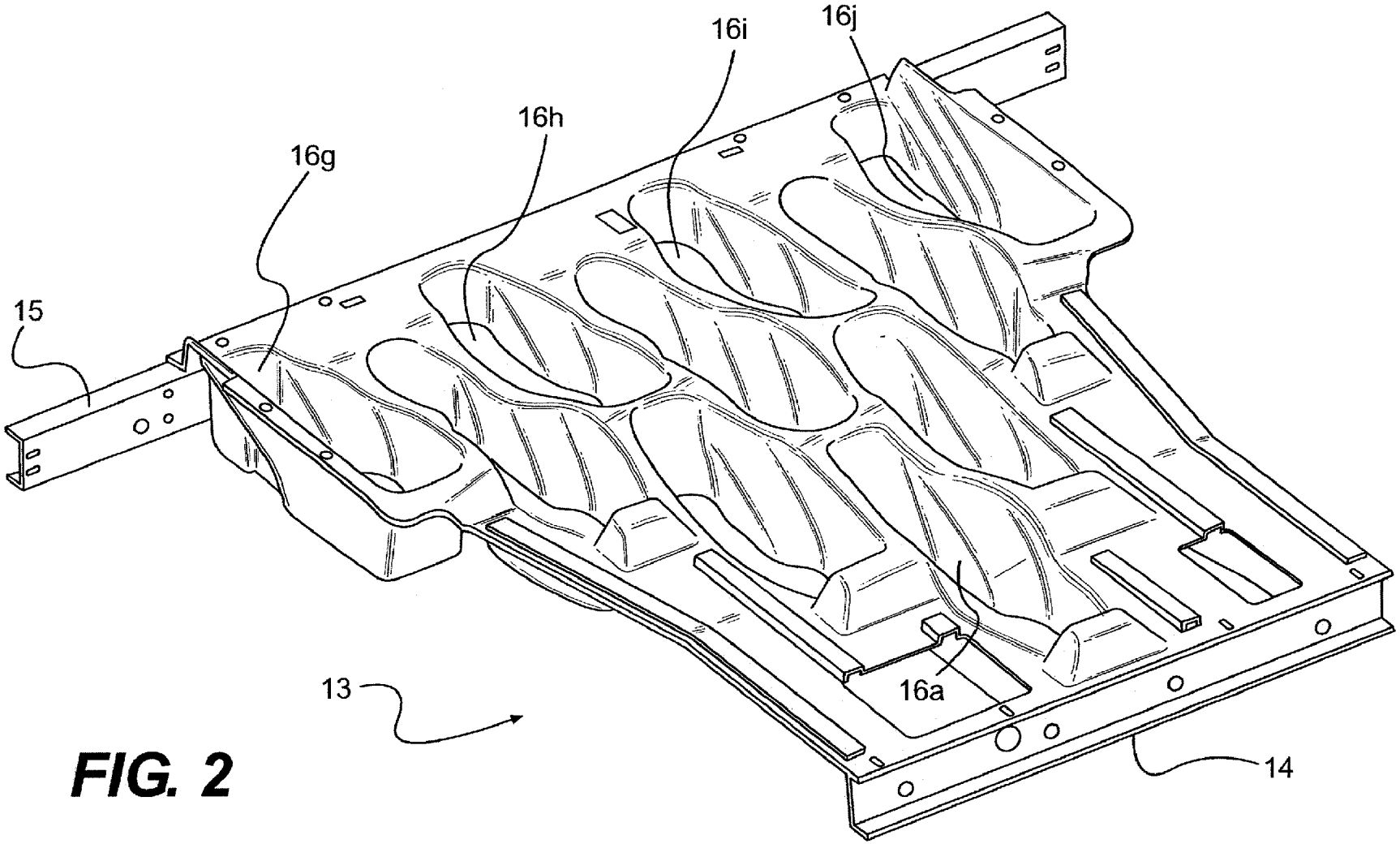
FIG. 2 is a perspective view of a first embodiment of a storage bin according to the invention, assembled to a support frame.

FIG. 2 illustrates a storage bin 13 for a bowling pin spotting apparatus according to a first embodiment of the invention. The bin 13 is mounted to a frame that includes channels 14, 15 made of light tubular steel, for example.

The bin 13 is to be used in conjunction with a shuttle assembly for retaining pins in. and releasing pins from, the ten cavities 16*a*-16*j* of the bin to the spotting/respotting table, such as the shuttle linkage assembly disclosed in U.S. Pat. No. 5,439,418,the disclosure of which is hereby incorporated by reference thereto for this purpose. In fact, the bin 13 could be substituted for the pin storage device 2 of U.S. Pat. No. 5,439,418 in a bowling pin spotting apparatus.

As can be seen, the bin 13 is not formed as a hollow structure in the manner of the bin of the aforementioned U.S. Pat. No. 5,439,418 and U.S. Design Pat. No. 366,510. In fact, because bin 13 is not hollow, it could not be made by means of a rotational mold. Instead, bin 13 is made by thermoforming. In addition, in a particular embodiment of the invention, the bin made from a high-density polyethylene (HDPE), rather than from the LOPE LDPE disclosed in U.S. Pat. No. 5,439,418, processed into sheets for manufacture by thermoforming.

During a period of investigation and impact testing, it has been determined that, rather than using a LDPE and relying upon a rotomolding process to make a one-piece plastic bin, as disclosed by U.S. Pat. No. 5,439,418,a different material and a different manufacturing process could be implemented to advance the technology currently used in bowling pinspotting apparatuses. More specifically, it was determined that the bin 13 could be made from a high-density polyethylene (HDPE), processed into sheets, such as by extrusion, and used in a thermoforming process. It should be recognized that other materials are also contemplated by the present invention such as, for example, other plastics including other polyethylene type of materials, and even more specifically, Thermo-Plastic Olefin (TPO), and more particularly HDPE manufactured by PrimeX Plastic Corporation. The HDPE or other materials contemplated by the invention provide high impact for the bowling pinspotting apparatus. Hereinafter, the present invention is discussed mainly with reference to HDPE; although the other high impact materials discussed herein work equally well with the invention.

Thermoforming has a special cross-linking property that rotomolding, which relies upon the heating and melting of a polymer powder, does not. Specifically, cross-linking is introduced into the HDPE material when the material is extruded and rolled into sheet form, for subsequent use in thermoforming, which causes the long polymer molecule chains to bind together at various intersections along their lengths. Interweaving and cross-linking of the polymer chains yield a plastic material that is very strong, flexible and, most importantly for the particular subject matter of the invention, increased impact resistance. In a particular embodiment, the extruded sheet used in manufacturing the bin 13 has a thickness of 5/16 inch, although that particular thickness is not intended to limit the invention.

Thermoforming is a method of manufacturing plastic parts by preheating a flat sheet of plastic, such as an aforementioned extruded sheet of HDPE, the edges of which are damped in a frame, then bringing the sheet into contact with a single-surface temperature-controlled mold whose shape it takes. The mold can be typically made of cast or machined aluminum, due to the relatively high coefficient of thermal conductivity of aluminum, which allows for consistent cooling cycle times through a production run, although other materials can be used, particularly if low volume productions are contemplated. Once cooled, the formed sheet is removed from the mold and trimmed as necessary.

Thermoforming broadly relates to any process of forming a sheet of plastic, typically a thermoplastic sheet, which comprises heating the sheet until it become pliable and forcing it onto or into a surface mold. Tooling used in thermoforming is referred to as either male or female. If a male mold is used, the sheet is forced onto the mold; if a female mold is used, the sheet is forced into the mold. Typically, the forcing of the sheet into or onto the surface mold is accomplished with a vacuum, although air pressure and direct mechanical force can be used, including combinations of such forces.

Figure 1:
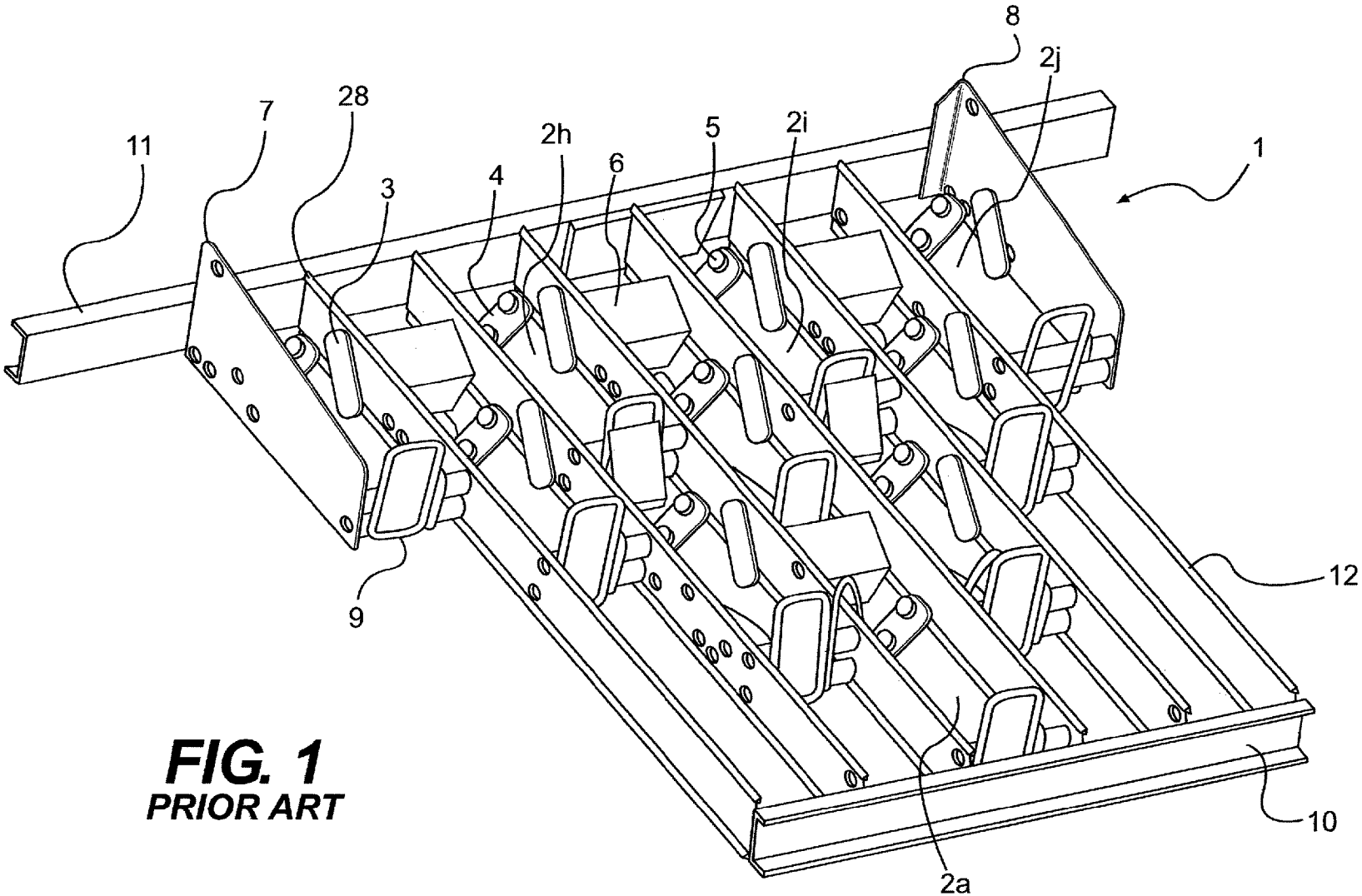
FIG. 1 PRIOR ART
FIG. 1 is a perspective view of a prior pin spotter bin made largely from sheet steel and associated parts.
Figure 3A:
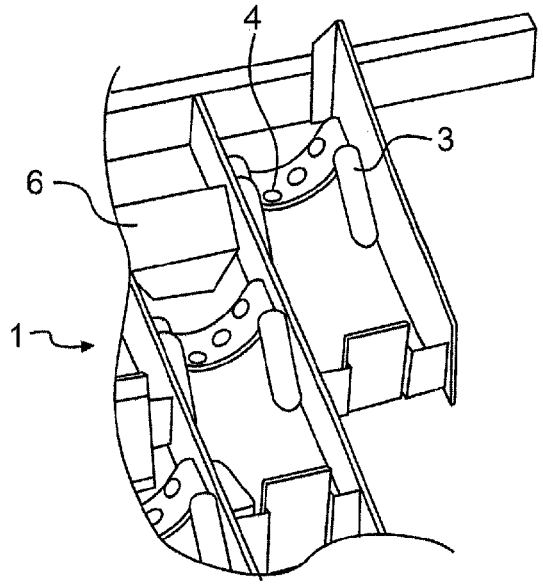
FIG. 3 illustrates, in perspective, a comparison between a portion of the prior bin of FIG. 1 and a portion of the bin of FIG. 2 according to the invention.
Figure 3B:
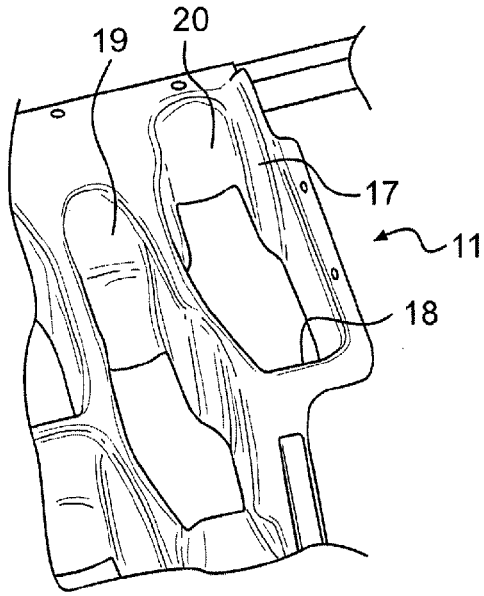

The thermoforming process used to produce bin 13 of FIG. 2 is made using a male mold (not shown). That is, the heated sheet of extruded plastic (such as HDPE) is draped over the projecting surfaces of the male mold, such as projections shaped for the purpose of forming the oblong cavities **16*a*-16*j* of the bin 13. The details of the surfaces of the bin 13 of FIG. 2, including the relatively complex shapes of the cavities, are largely based upon the assembled geometries of the metal bin 1 of FIG. 1. For example, as shown in FIG. 3, the pin guiding surfaces 17 of the bin 13 of the first embodiment of the invention are designed to replicate, in form and function, the pin guides 3 of the prior bin 1. Similarly, the end surfaces 18 of the bin 13 of the first embodiment of the invention are designed to replicate, in form and function, the pin butt guides 9 of the prior bin 1. Further, the top surfaces 19 of the bin 13 of the first embodiment of the invention are designed to replicate the top surfaces of the spacers 6 of the prior bin 1. In addition, the shoulders 20 of the bin 13 of the first embodiment of the invention are designed to replicate the pin assembly brackets 4 of the prior bin 1**. Other similarities can also be observed.

As with the bin of U.S. Pat. No. 5,439,418,each of the cavities **16*a*-16*j* of bin 13 defines a minimum cross sectional area, i.e., an opening having the general shape of a bowling pin taken along its longitudinal axis but having a width slightly larger than the width of a conventional bowling pin. As shown, for example, in FIG. 3, each of the cavities 16*a*-16*j* includes a shoulder 20 at its forward portion, i.e., the portion which corresponds to the head of a bowling pin. Each of the cavities 16*a*-16*j* is also shorter than the length of a conventional bowling pin and the cavities are constructed and arranged to bias the base of a bowling pin in a forward direction so that the head of the pin rests on the shoulder 20 in the forward part of a cavity 16 and the base of the pin is supported from below by movable support members of the shuttle assembly (not shown) when the pins are stored in the bin 13** in a first supported, or stored, position.

When pins are to be released from the bin 13, by means of the reciprocation of the support members of the shuttle assembly from beneath the pins, the pins pivot downward base-first through their respective cavities as opposite surfaces 17 (see FIG. 3) of the cavities support and guide the upper portion of the base of each pin in their pivoting and downward release from their respective cavities.

The geometry of the bin 13 of the first embodiment of the invention differs from that of U.S. Pat. No. 5,439,418 and U.S. Design Pat. No. 366,510.A first difference relates to the geometry of the cavities **16*a*-16*j*. In US '418 and USD '510, the cavities are relatively widely scalloped along their interior surfaces from the upper surface of the bin down to the through opening of each cavity. This geometry has been found to allow the pins to bounce around as they are delivered by the distributor, rather than to settle into the various cavities 16*a*-16*j* relatively quickly. By contrast, as can be seen in FIGS. 2 and 3**, the interior surfaces of the cavities are more steeply inclined, which allow the pins to bounce around less and to become more firmly engaged in the respective cavities as the pins are delivered by the distributor. For example, the interior surfaces of the cavities in the area of the head of the pin and the base of the pin provide for a closer fit between the cavities and the pins.

In addition, the geometry of the bins of US '418 and USD '510 includes a relatively flat upper surface surrounding the pin cavities, whereas the bin of the invention includes a number of functional projections "P" extend upwardly from the area surrounding the cavities, which also facilitate the settling of the distributed pins within the various cavities.

The utilization of the process of thermoforming for the manufacture of a bowling pin storage bin, particularly with its unique geometry, has been found to present challenging issues to be overcome, such as potential part defects such as webbing, surface blemishes, thin material areas at key impact areas, and warping. As recognized by those skilled in the art of thermoforming, as a heated pliable sheet of plastic brought down to be formed over the male cavity, or vice versa, the top surface of the part is controlled by the mold. That is, the area of the mold that contacts the plastic first tends to be the thickest, while the remainder of the plastic sheet is drawn and thins as the sheet is brought further down upon the mold. Using a thermoforming technique, sometimes referred to as drape forming, using a male mold, seemed logical because of the complexity of the pocket geometry, i.e., the complex shapes of the cavities **16*a*-16*j***. But, while the top surface is controlled by the mold and tends to be the thickest, with this technique the top surface forms the bottom of the bin and the top of the bin, which is used for mounting the bin, is created by the uncontrolled surface.

Another challenge that is confronted when thermoforming a bin of the invention is that of forming key edges of internal cup shapes. With thermoforming as the plastic sheet is moved onto or into the irregularities of the mold, such as forming the plastic sheet around corners, there is a tendency for the plastic to form relatively large radii which, when compared to the prior art sheet metal bin, such as that shown in FIG. 1, can considerably change the ability of the shapes thus formed to function in the manner intended. The result can disadvantageously affect the ability of the bin to consistently catch and hold the incoming pins. Also, because the bin must function as a two-layer pin storage unit, the ability to catch and hold a second layer of pins can be exacerbated by the aforementioned tendency to form large radii in the internal geometry of the pin cavities.

Still further, because of unique application of thermoforming techniques to the manufacture of a bowling pin storage bin, which is a large part, which includes ten relatively complex and deep pockets, one is challenged to ensure that the horizontal stiffness of the finished product is adequate. This consideration is of importance, for example, particularly when considering the use to which the bin is put, such as, e.g., if a person were to support their weight by leaning out over the bin to grab an orphaned pin.

In addition, unlike prior art sheet metal bins, which can be relatively precisely and firmly mounted to the supporting frame, a plastic bin produces additional challenges. For example, rubber grommets can be used at least fastening locating to allow the bin to expand and contract thermally with temperature change, to help soften impact noise, and to silence any rattle of large free floating washers, e.g., used to retain the bin at locations where shoulder screws are used. Inherent in thermoforming HDPE, or other plastic, is the inability to accurately trim and machine the mounting holes. Because of this, mounting holes can be replaced with slots to ease any hole alignment issues.

Figure 4:
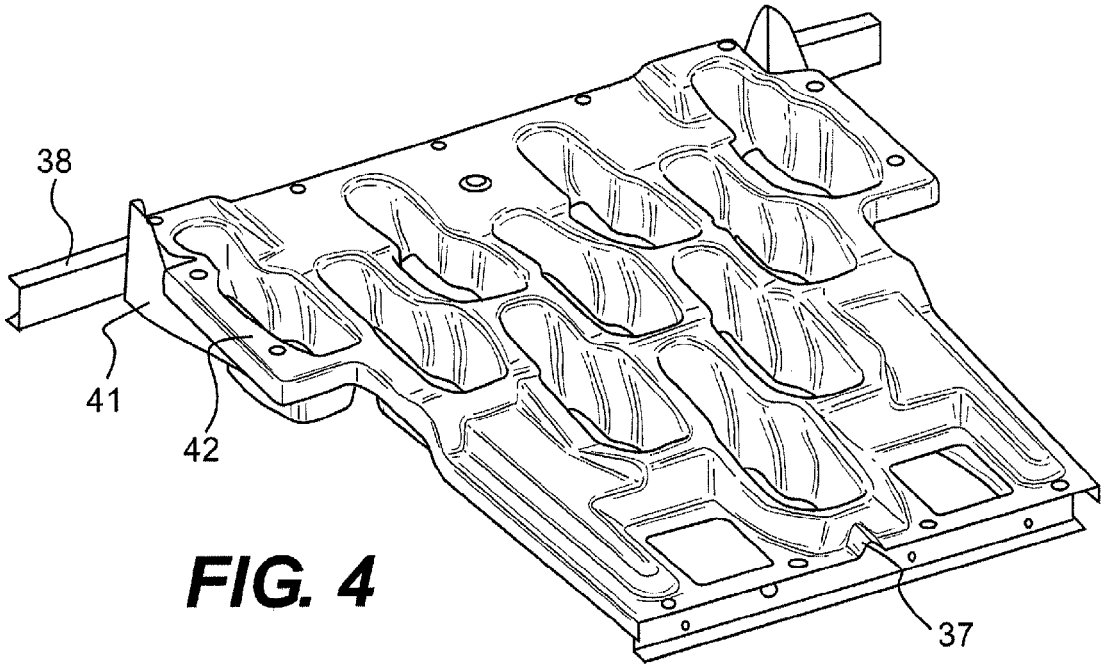
FIG. 4 is a perspective view of a second embodiment of a storage bin according to the invention, assembled to a support frame.
Figure 4A:
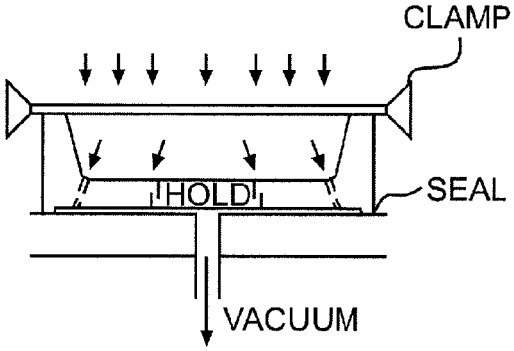
FIGS. 4*a* and 4*b* schematically illustrate two stages of a thermoforming process that can be used to manufacture the second embodiment.
Figure 4B:
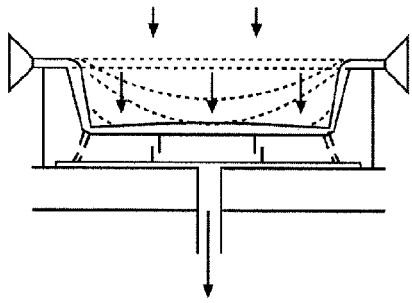
Figure 4C:
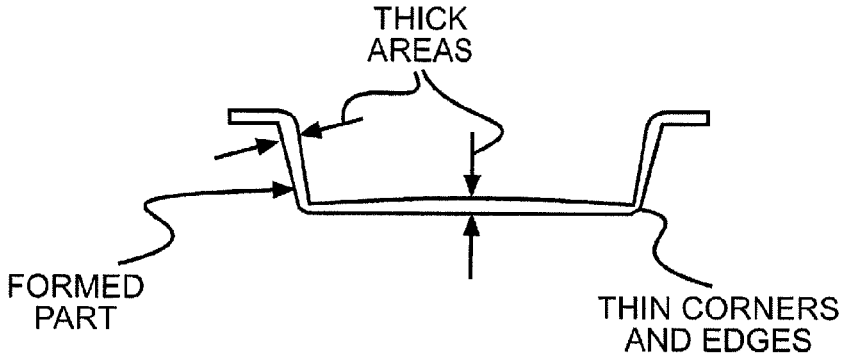
FIG. 4*c* schematically illustrates a part made by the process of FIGS. 4*a*, 4*b;*

FIG. 4 illustrates a second embodiment of a storage bin according to the invention. In addition to variations in the geometry of the bin of this embodiment, compared to that of FIG. 2, this embodiment is preferably formed using female tooling in the thermoforming process. In contrast to utilizing male tooling, i.e., a male cavity or mold, the heated pliable polymer sheet is bought into engagement with the mold to assume the shapes of the recesses therein. FIGS. 4*a* and 4*b* schematically illustrate two stages of a thermoforming process using a female mold and relying upon a vacuum assist in positioning the polymer sheet. In FIG. 4*a*, after the application of suitable heating, schematically shown as radiating from above, to render the extruded sheet pliable, while clamped in a frame, the extruded sheet is brought to engage the female mold. As can be seen in FIG. 4*a*, the top surfaces of the mold are the first surfaces to come into engagement with the sheet. As the vacuum continues to be applied through the mold, shown in FIG. 4*b*, atmospheric pressure pushes the pliable sheet into the recess of the female mold, stretching the sheet to lie against the inner surfaces of the mold. After cooling and removal of the clamped frame, FIG. 4*c* shows the part that has been formed. FIG. 4*c* schematically illustrates the tendency of those areas of the sheet which are the last to engage the mold are the thinnest, i.e., the areas which had been stretched during the application of vacuum to the pliable sheet. The thickest areas of the part are those which first engaged the mold, particularly the top of the part.

Figure 5:
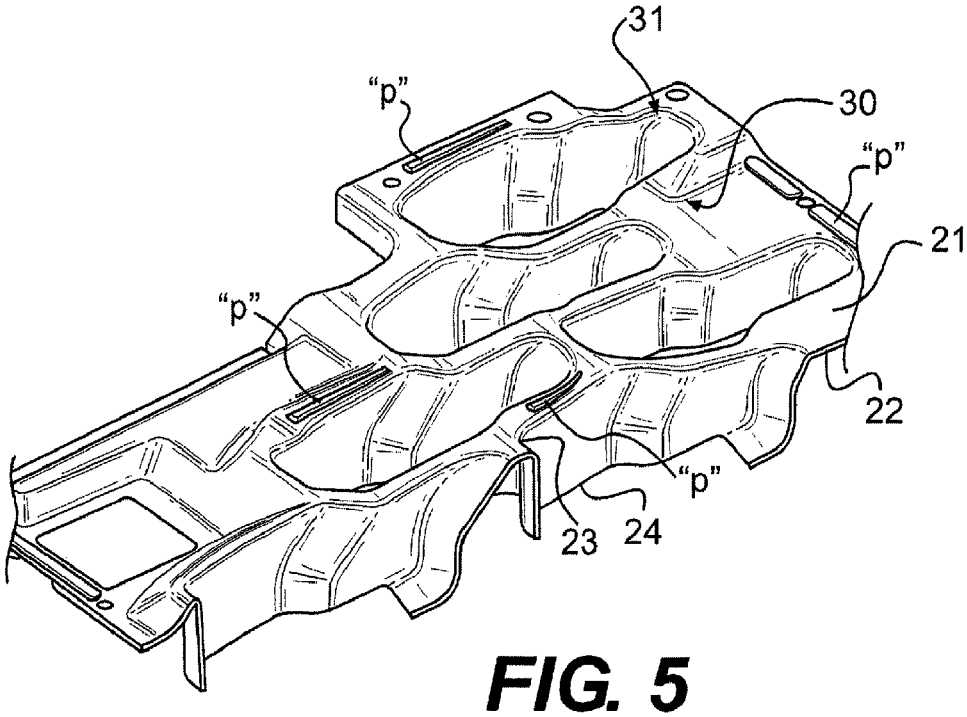
FIG. 5 is a cross-sectional perspective view of the second embodiment, taken through the cavities of the first and fifth pins.

Returning to the second embodiment of the storage bin of the invention, FIG. 5 illustrates, in perspective view, a longitudinal cross section of the bin. Because the bin of FIG. 5 is produced with a thermoforming process like that of FIGS. 4*a*, 4*b*, the top surfaces 21 of the bin are those that are "uncontrolled," i.e., surfaces that had not been in direct engagement with surfaces of the mold, whereas the undersurfaces 22 of the bin are those that are "controlled," i.e., surfaces that are formed by being in direct engagement with the surfaces of the mold. In addition, unlike the bin of the first embodiment shown in FIG. 2, the uppermost areas 23 of the bin are those which, during manufacture according to a process like that of FIGS. 4*a*, 4*b*, are areas of the pliable sheet that had engaged the surfaces of the female mold first and, therefore, they are the thicker areas of the bin, whereas the bottom areas of the bin of FIG. 5 are those that had engaged surfaces of the female mold later in the process and, therefore, they are the thinner areas, but for which impact resistance is not as much of a factor. Although the surfaces of the bottom areas include those which are contacted by the distributed pins, the impact forces are typically not as significant as those that are absorbed the surfaces of the uppermost areas 23.

Figure 6I:
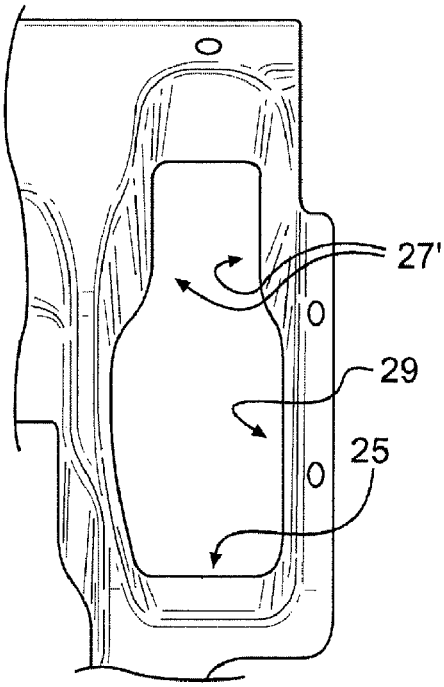
FIG. 6 illustrates top views of localized portions of the 10-pin areas of the first and second embodiments of the storage bins according to the invention.
Figure 6:
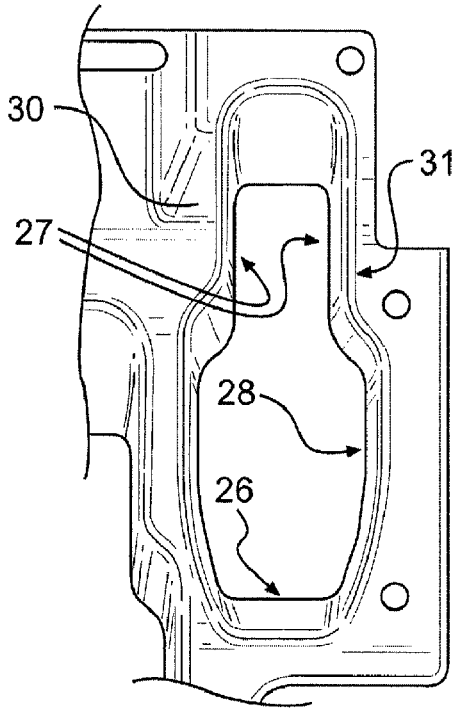

FIG. 6 shows top views of localized portions of the 10-pin areas of the first embodiment (portion 1) and the second embodiment (portion 11) of the storage bins according to the invention. Because the bins are essentially symmetrical on either side of a vertical longitudinal median plane through the one and five pins, the portions of the bins shown in FIG. 6 also are representative of the 7-pin areas. The rear wall 25 of the embodiment I is a double drafted backstop wall at 12 degrees to the vertical. Although the pins that are delivered to the bin by the distributor rebound within, the pockets for the seven and ten pins, following initial impact with the bin, fall and settle within the pockets, this somewhat flat, angled backstop can occasionally cause pins to rebound up and out rather than down and in. The double drafted backstop wall 26 of the embodiment II creates a more horizontal impact surface.

FIG. 6 also shows that the pin receptacle geometry of the pockets of embodiment II includes more vertical internal shoulders 27 to catch and hold the pins on rebound compared to those of embodiment I, such as the more angled surfaces such as surfaces 27' of embodiment II. Further, the pockets of embodiment II are more "pin-shaped" than those of embodiment I. That is, particularly for the pockets for the 7-pin and the 10-pin, the outside walls 28 for engagement with the body of a pin more closely follow the contour of pin, compared to the outside walls 29 of the pockets of embodiment I.

Still further, the embodiment II includes a scalloped entrance edge 30, shown in both FIGS. 5 and 6, which facilitate entry of the pins particularly into the pockets for the seven and ten pins. In addition, a terraced section 31, again particularly for the pockets for the seven and ten pins, help to trap and hold the second layer pin. That is, as mentioned above, the bins of both embodiment I and embodiment II (FIGS. 2 and 4, respectively), are constructed and arranged to hold two layers of pins, i.e., second pin lying upon a first pin, so that the bin can readily supply a pin to the pin table below the bin when needed.

Figure 7I:
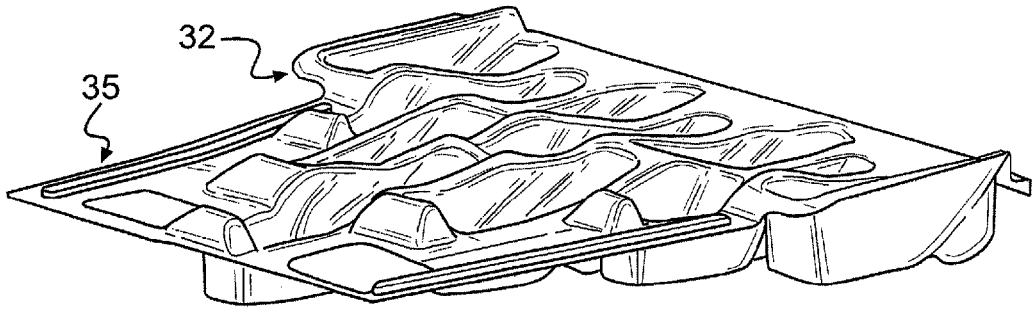
FIG. 7 illustrates the bins of the first and second embodiments, with particular reference to structures facilitating horizontal stiffness.
Figure 7:
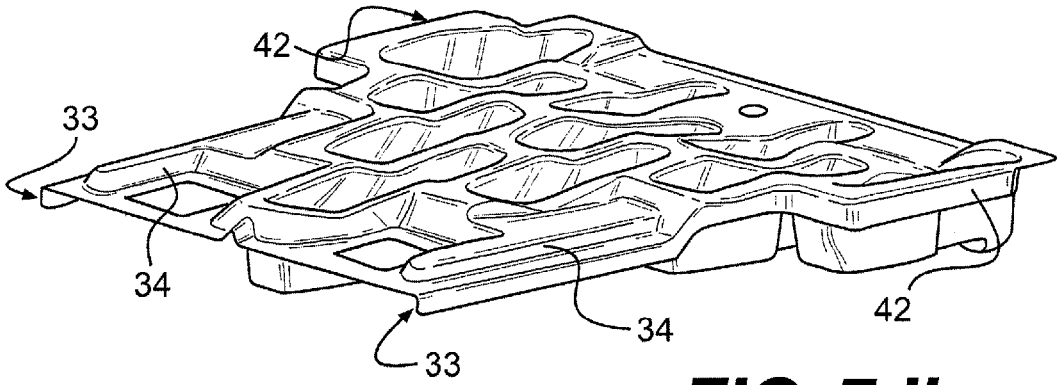

FIG. 7 illustrates the bins of the first and second embodiments, with particular reference to structures facilitating horizontal stiffness. Structural shapes of embodiment II include those that aid in longitudinal support of the bin, which also facilitate the thermoforming process. For example, the somewhat abrupt backstop bosses 32 of embodiment I are not a feature of embodiment II, the pockets of embodiment II instead having a smoother perimeter that particularly improves the catch and hold of second layer pins. In addition, the side edges 33 of the bin of embodiment II are vertically flanged, whereas those of the bin of embodiment I are not.

Also for the purpose of increasing stiffness, the storage bin of embodiment II includes deep and integrated ribs 34 extending generally longitudinally toward the front edge of the bin, whereas the ribs 35 of the bin of embodiment I are shallow.

Figure 8:
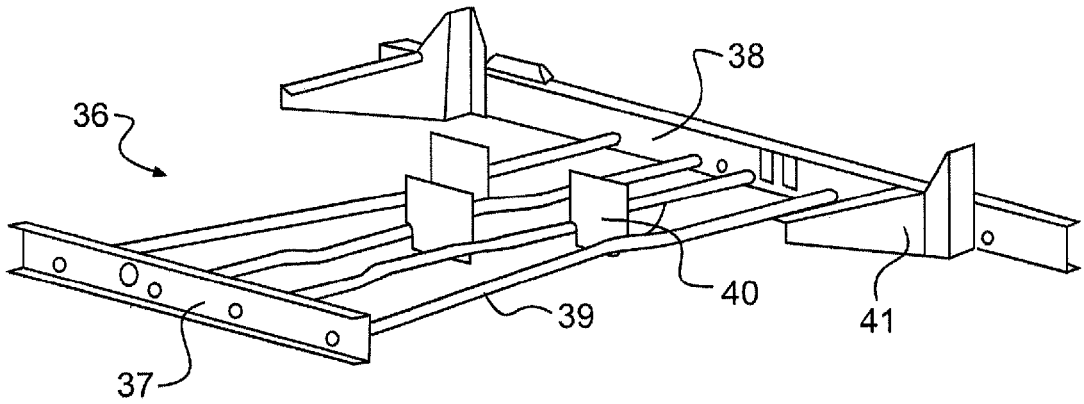
FIG. 8 illustrates a support frame for the storage bins of the first and second embodiments of the invention.

FIG. 8 illustrates a support frame 36 for the storage bins of the first and second embodiments of the invention. The frame can be seen, at least in part, in FIGS. 2 and 4, in combination with the bins of the first and second embodiments, respectively. Both bins are mounted to a C-channel sections 37, 38 at the front and rear edges, such sections being made from steel, for example, or other suitable material. Extending between the C-channel sections for the purpose of aiding in the support of the center section of the bins are generally longitudinally extending tubular members 39, shaped to fit the contours of the underside of the bins, in conjunction with attached vertical plates 40. Like the C-channel sections, the tubes 39 and plates 40 can be made from steel or other material. In addition, shapes other than those particularly illustrated for the members 39 and 40 could alternatively be utilized.

As shown in FIG. 8, and in combination with the bin of the second embodiment in FIG. 4, the brackets 41, made of steel or other suitable material, are attached to the flanges 42 at the pockets for the seven and ten pins, which flanges also support the shuttle. The combination of attachments shown in FIG. 8, and in FIG. 4, helps to reinforce both the shuttle and the bin, particularly for adequately supporting the bin if one were to put his/her weight on one of the flanges to prevent the twisting of the rear channel. The increased stiffness of the edges of the second embodiment also increase such reinforcement.

Figure 9:
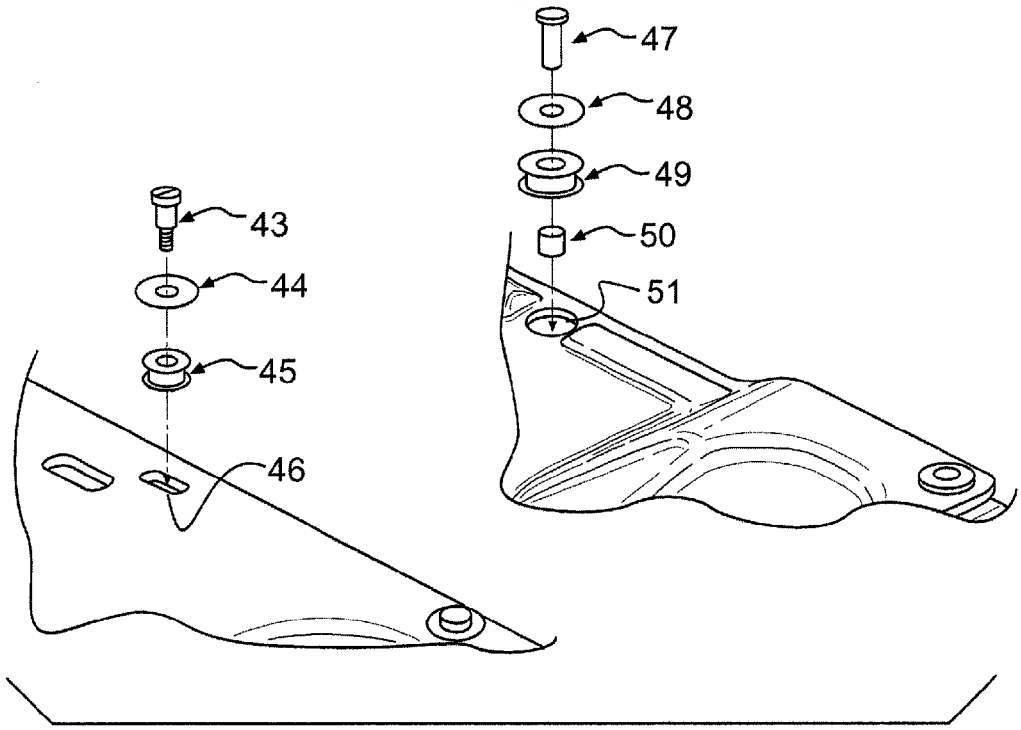
FIG. 9 illustrates respective portions of the storage bins of the first and second embodiments of the invention, with exploded showings of the mounting hardware.

FIG. 9 illustrates respective portions of the storage bins of the first and second embodiments of the invention, with exploded showings of the mounting hardware. For each bin, only one assembly of hardware components is shown in detail, it being understood that the bins are mounted in a plurality of locations along its periphery, for example. The storage bin of the first embodiment I includes a shoulder screw 43 (¼×⅜ inch, #10 thread, e.g.), to extend through a slot 46, a fender washer 44 (¼ in. ID, 1 in. OD, e.g.), a grommet 45 (¼ in. ID, 7⁄16 in. hole, ⅝ in. OD, e.g.), and a flex lock nut (3⁄16 in., not shown). The storage bin of the second embodiment II includes a cap screw 43 (¼×1 inch, e.g.), to extend through a hole 51, a fender washer 48 (¼ in. ID, 1 in. OD, e.g.), a grommet 49 (⅜ in. ID, 718 in. hole, 1 1⁄16 in. OD, e.g.), and a flex lock nut (¼ in., not shown).

Grommet diameters play a large role in the extent to which a HDPE bin can expand and contract before damage is done to the bin or to the fasteners holding it. The embodiment I uses a radial grommet 45 having a radial modulus of 3⁄32 inch. The embodiment II uses a grommet 49 with a radial modulus of ¼ inch, allowing 25% more movement in all directions. The grommet 49 is mounted in a hole 51 rather than a slot (46, e.g.) for the purpose of ensuring proper function of the grommet in all physical situations that would be encountered during use.

Figure 10:
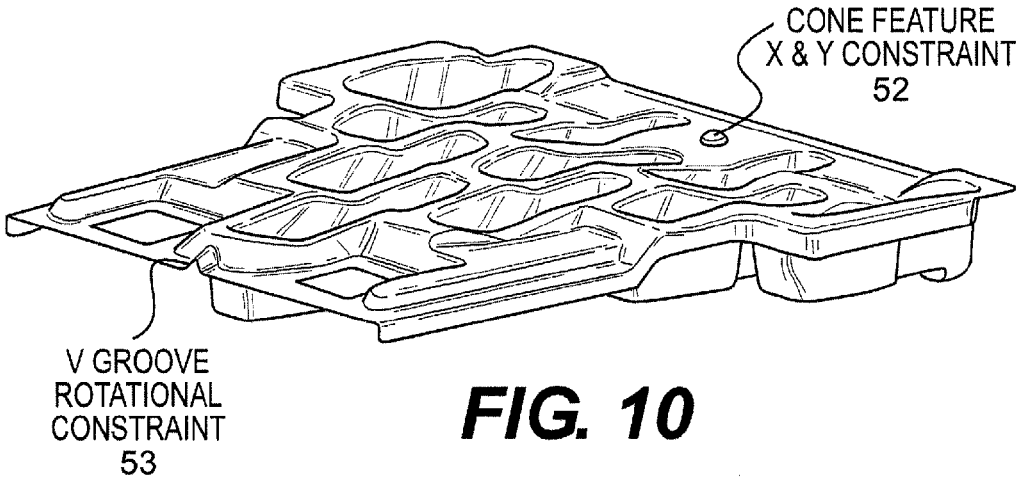
FIG. 10 illustrates the storage bin of the second embodiment with indexing and time stamp features.

FIG. 10 illustrates the storage bin of the second embodiment II with indexing and time stamp features. During the thermoforming manufacturing process described above, after the part which is to become a bin according to the invention is removed from its mold, the part must be removed from its clamping frame, trimmed and routed to create the particular details necessary, such as the openings at the underside of the bin. Such trimming and routing is typically automated and, therefore, the part must be precisely positioned. FIG. 10 illustrates a conical feature 52 to constrain the part in the X and Y directions, as well as a V-groove feature 53 to rotationally constrain the part, throughout the trimming and routing process. In addition, adjacent the conical feature, an in-mold time stamp can be formed on a control surface of the part.

The storage bin assembly of the invention, manufactured and constructed as described above, improves upon prior metal bins and the known bin made by a rotomolding process, providing significant stiffness and impact resistance, not suffering from premature material fatigue, and which can withstand a significant number of impacts with bowling pins, such as at least 1,000,000 cycles of a pin spotting apparatus The invention is not limited to the particulars of the embodiments described hereinabove as examples, but encompasses any equivalent embodiment. For example, although sheets of a high molecular weight polyethylene (HMWPE) can be used for the storage bins of both the first and second embodiments, the invention encompasses the manufacture from other polymers. In addition, the polymer sheets used for the storage bins of both the first and second embodiments can be formed from 5⁄16 inch extruded sheets (HMWPE, e.g.). although other thicknesses are also contemplated. In this regard, because of the stiffening described above in connection with the storage bin of the second embodiment, the invention encompasses the manufacture of bins of the second embodiment from ¼ inch thick sheets, which results in savings of material and related processing time, thereby lowering the cost of manufacture.

The invention claimed is:

1. A bowling pin storage bin assembly for a pin-spotter apparatus, said bin assembly comprising:

a one-piece thermoformed structure, said structure including a plurality of elongated pockets;

each of the pockets having an upper entry opening for receiving at least one pin from a distributor and a lower exit opening for delivery to a bowling lane;

each of the pockets having surfaces for holding said at least one pin for storage in the bin while awaiting said delivery, said surfaces structured to bias a base of the at least one pin such that a head of the at least one pin rests on a shoulder of each of the pockets; and a scalloped entrance edge which is structured to facilitate entry of the at least one pin into of each of the pockets.

2. A bowling pin storage bin assembly according to claim 1, wherein:

said one-piece thermo-formed structure is formed from a single extruded polymer sheet, said structure having a non-hollow geometry.

3. A bowling pin storage bin assembly according to claim 2, wherein:

said one-piece thermo-formed structure is formed from a single extruded polymer sheet having a thickness of no more than 5⁄16 inch.

4. A bowling pin storage bin assembly according to claim 1, further comprising:

a support frame including a front section, a rear section, and a plurality of members extending generally longitudinally between said front and rear sections.

5. A bowling pin storage bin assembly according to claim 4, wherein:

said support frame further comprising side brackets connected to said one-piece thermo-formed structure adjacent said rear section.

6. A bowling pin storage bin assembly according to claim 1, wherein each of the pockets forms cavities that are inclined such that the at least one pin becomes engaged in the respective cavities as the at least one pin is delivered by the distributor.

7. A bowling pin storage bin assembly according to claim 1, further comprising thinner areas and thicker areas, the thinner areas being areas which have been stretched during application of vacuum to a pliable sheet and the thicker areas being at a top part thereof which first engaged a mold.

8. A bowling pin storage bin assembly according to claim 1, further comprising a rear wall of the pockets that includes a double drafted backstop wall at 12 degrees to a vertical.

9. A bowling pin storage bin assembly according to claim 1, wherein the pockets include vertical internal shoulders structured to catch and hold the at least one pin on rebound.

10. A bowling pin storage bin assembly according to claim 1, further comprising a terraced section for the selected pockets.

11. A bowling pin storage bin assembly according to claim 1, further comprising integrated ribs extending generally longitudinally toward a front edge.

12. A bowling pin storage bin assembly according to claim 1, further comprising a support frame including C-channel sections at front and rear edges and, extending between the C-channel sections, generally longitudinally extending tubular members shaped to fit contours of an underside of the one-piece thermoformed structure.

13. A bowling pin storage bin assembly according to claim 1, further comprising brackets attached to flanges at selected of the elongated pockets.

14. A bowling pin storage bin assembly according to claim 1, wherein the one-piece thermoformed structure is high density polyurethane (HDPE).

15. A method of manufacturing by thermoforming the bowling pin storage bin assembly of claim 1, said method comprising:

heating a sheet of thermoplastic polymer to pliability;

moving said heated sheet into engagement with a single controlled side of a thermoforming mold;

cooling said sheet;

removing said sheet from said mold as the one-piece thermoformed structure; and constraining the one-piece thermoformed structure in X, Y and rotational directions during a trimming and routing process.

16. A method of manufacturing according to claim 15, wherein:.

said thermoforming mold is a female mold having recesses for forming upward-facing uncontrolled surfaces of the bin.

17. A method of manufacturing according to claim 15, wherein:

said thermoforming mold is a male mold having recesses for forming upward-facing controlled surfaces of the bin.

18. A bowling pin storage bin assembly for a pin-spotter apparatus, said bin assembly comprising:

a one-piece thermoformed structure, said structure including a plurality of elongated pockets;

each of the pockets having an upper entry opening for receiving at least one pin from a distributor and a lower exit opening for delivery to a bowling lane;

each of the pockets having surfaces for holding said at least one pin for storage in the bin while awaiting said delivery, said surfaces structured to bias a base of the at least one pin such that a head of the at least one pin rests on a shoulder of each of the pockets; and a number of projections extending upwardly from an area surrounding cavities which form the pockets.

19. A bowling pin storage bin assembly for a pin-spotter apparatus, said bin assembly comprising:

a one-piece thermoformed structure, said structure including a plurality of elongated pockets;

each of the pockets having an upper entry opening for receiving at least one pin from a distributor and a lower exit opening for delivery to a bowling lane;

each of the pockets having surfaces for holding said at least one pin for storage in the bin while awaiting said delivery, said surfaces structured to bias a base of the at least one pin such that a head of the at least one pin rests on a shoulder of each of the pockets; and a conical feature to constrain the one-piece thermoformed structure in X and Y directions, and a groove feature to rotationally constrain the one-piece thermoformed structure, throughout a trimming and routing process.

* * * * *